US011262697B2

(12) United States Patent
Goda et al.

(10) Patent No.: US 11,262,697 B2
(45) Date of Patent: Mar. 1, 2022

(54) IMAGE FORMING APPARATUS

(71) Applicant: FUJIFILM Business Innovation Corp., Tokyo (JP)

(72) Inventors: Toshihiro Goda, Kanagawa (JP); Yukihiro Ichiki, Kanagawa (JP); Akira Shimodaira, Kanagawa (JP); Keita Hashimoto, Kanagawa (JP); Masaki Suto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/940,772

(22) Filed: Jul. 28, 2020

(65) Prior Publication Data

US 2021/0294263 A1 Sep. 23, 2021

(30) Foreign Application Priority Data

Mar. 19, 2020 (JP) ..... JP2020-050140

(51) Int. Cl.
*G03G 21/20* (2006.01)
*G03G 15/01* (2006.01)
*G03G 15/16* (2006.01)

(52) U.S. Cl.
CPC ..... *G03G 21/206* (2013.01); *G03G 15/0194* (2013.01); *G03G 15/1615* (2013.01); *G03G 2215/0119* (2013.01)

(58) Field of Classification Search
CPC ..... G03G 15/0194; G03G 15/1615; G03G 21/206; G03G 2215/0119
See application file for complete search history.

(56) References Cited

U.S. PATENT DOCUMENTS 5,805,967 A * 9/1998 De Bock ..... G03G 15/0131 399/299
5,821,968 A * 10/1998 Ohyama ..... B41J 11/0005 347/104
5,837,408 A * 11/1998 Parker ..... H04N 1/508 430/45.31
5,893,018 A * 4/1999 De Bock ..... G03G 15/24 399/302
6,097,924 A * 8/2000 Okuyama ..... G03G 15/167 399/101

(Continued)

FOREIGN PATENT DOCUMENTS

JP 2007-304192 A 11/2007
JP 2007-310226 A 11/2007
JP 2014-059391 A 4/2014

*Primary Examiner* — David J Bolduc
(74) *Attorney, Agent, or Firm* — Sughrue Mion, PLLC

(57) ABSTRACT

An image forming apparatus includes: a medium transport path; a first image transport path that is disposed so as to oppose the medium transport path and along which an image to be formed on the medium is transported; an image forming part that forms the image and is disposed adjacent to the first image transport path; and a second image transport path that is disposed so as to oppose the medium transport path, that is located at a distance from the image forming part, and along which an image to be formed on the medium is transported, the second image transport path, the first image transport path, and the medium transport path, together surrounding the image forming part.

15 Claims, 6 Drawing Sheets

(56) References Cited

U.S. PATENT DOCUMENTS 6,163,672 A * 12/2000 Parker ..... G03G 15/0184 399/223
6,188,861 B1 * 2/2001 Parker ..... G03G 15/0184 399/299
6,819,902 B2 * 11/2004 Toyohara ..... G03G 15/0184 399/227
6,941,094 B2 * 9/2005 Omata ..... G03G 15/1605 399/110
6,947,682 B2 * 9/2005 Kosugi ..... G03G 15/1665 399/297
6,999,196 B2 * 2/2006 Ishida ..... G03G 15/1625 358/1.4
7,046,947 B1 * 5/2006 Castelli ..... G03G 15/6564 399/299
7,136,613 B2 * 11/2006 Sato ..... G03G 21/206 399/299
7,171,134 B2 * 1/2007 Denton ..... G03G 15/045 399/49
7,206,536 B2 * 4/2007 Julien ..... G03G 15/50 399/110
7,463,835 B2 12/2008 Harumoto
7,558,510 B2 * 7/2009 Iwasaki ..... G03G 15/5008 399/167
7,623,814 B2 * 11/2009 Kuo ..... G03G 15/0178 399/223
7,702,259 B2 * 4/2010 Eun ..... G03G 15/04045 399/223
7,869,739 B2 * 1/2011 Mashtare ..... G03G 21/1604 399/107
7,937,014 B2 5/2011 Kawamata
7,957,660 B2 * 6/2011 Kaneko ..... G03G 15/2039 399/67
8,121,505 B2 * 2/2012 Jackson ..... G03G 15/50 399/66
8,358,944 B2 * 1/2013 Yamade ..... G03G 15/0194 399/39
8,446,597 B2 * 5/2013 Enami ..... G03G 15/0178 358/1.12
8,682,233 B2 3/2014 deJong et al.
8,712,299 B2 * 4/2014 Sugita ..... G03G 15/1615 399/312
8,918,039 B2 12/2014 Arikawa et al.
2001/0046389 A1 * 11/2001 Kuribayashi ..... G03G 15/1645 399/45
2002/0064404 A1 * 5/2002 Iwai ..... G03G 15/234 399/309
2002/0122679 A1 * 9/2002 Omata ..... G03G 15/1615 399/309
2003/0007812 A1 * 1/2003 Mochimaru ..... G03G 15/5087 399/309
2003/0086732 A1 * 5/2003 Abe ..... G03G 15/0131 399/299
2004/0174426 A1 * 9/2004 Nomura ..... B41J 2/45 347/238
2005/0190250 A1 * 9/2005 Howarth ..... B41J 11/04 347/104
2006/0033968 A1 * 2/2006 Maki ..... B41J 11/48 358/498
2006/0045565 A1 * 3/2006 Ueno ..... G03G 21/181 399/111
2006/0055767 A1 * 3/2006 Mochimaru ..... G03G 15/5008 347/234
2006/0072929 A1 * 4/2006 Takahashi ..... G03G 21/1647 399/13
2006/0120742 A1 * 6/2006 Kodama ..... G03G 15/0184 399/49
2006/0120772 A1 * 6/2006 Kitazawa ..... G03G 15/0194 399/301
2006/0188299 A1 * 8/2006 Matsumoto ..... G03G 15/0142 399/302
2006/0251432 A1 * 11/2006 Shibata ..... G03G 15/0266 399/44
2007/0014596 A1 * 1/2007 Sohmiya ..... G03G 15/238 399/307
2007/0098472 A1 * 5/2007 Saeki ..... G03G 15/657 399/400
2007/0212104 A1 * 9/2007 Miyamoto ..... G03G 21/206 399/92
2007/0253754 A1 * 11/2007 Kobayashi ..... G03G 15/754 399/303
2007/0268321 A1 * 11/2007 Kawamata ..... G03G 21/206 347/15
2008/0124123 A1 * 5/2008 Masuda ..... G03G 15/161 399/135
2008/0240780 A1 * 10/2008 Yamauchi ..... G03G 21/1695 399/121
2008/0304879 A1 * 12/2008 Tamura ..... G03G 15/0194 399/307
2009/0279906 A1 * 11/2009 Kuma ..... B65H 5/062 399/21
2009/0290892 A1 * 11/2009 Torimaru ..... G03G 15/161 399/66
2009/0317104 A1 * 12/2009 Katoh ..... G03G 15/0131 399/49
2010/0021219 A1 * 1/2010 Hori ..... B65H 5/004 399/388
2010/0040393 A1 * 2/2010 Kawahara ..... G03G 21/0011 399/101
2010/0061752 A1 * 3/2010 Sudo ..... G03G 15/50 399/66
2010/0196063 A1 * 8/2010 Iguchi ..... B41J 29/36 399/322
2010/0272449 A1 * 10/2010 Yoshida ..... G06K 15/14 399/2
2010/0303487 A1 * 12/2010 Miyakawa ..... G03G 15/2028 399/44
2010/0303514 A1 * 12/2010 Ishii ..... G03G 15/161 399/301
2010/0310285 A1 * 12/2010 Yasumoto ..... G03G 15/0131 399/302
2011/0013950 A1 * 1/2011 Furuya ..... G03G 15/167 399/302
2011/0076045 A1 * 3/2011 Sobue ..... G03G 15/5062 399/81
2011/0085828 A1 * 4/2011 Kosako ..... G03G 15/6567 399/301
2011/0204557 A1 * 8/2011 Ishikawa ..... B65H 3/18 271/18.1
2012/0107009 A1 * 5/2012 Yano ..... G03G 21/206 399/92
2012/0148301 A1 * 6/2012 Nakaegawa ..... G03G 15/657 399/121
2012/0207518 A1 * 8/2012 Krucinski ..... G03G 15/5058 399/301
2012/0251199 A1 * 10/2012 Miyazaki ..... G03G 15/167 399/314
2014/0028750 A1 * 1/2014 Fletcher ..... B41J 11/06 347/16
2014/0093269 A1 * 4/2014 Hirasawa ..... F24F 11/62 399/92
2015/0104204 A1 * 4/2015 Ishihara ..... G03G 15/1615 399/21
2016/0209785 A1 * 7/2016 Michishita ..... G03G 15/14
2016/0209787 A1 * 7/2016 Michishita ..... G03G 15/657
2016/0291541 A1 * 10/2016 Yamashita ..... G03G 21/206
2018/0067454 A1 * 3/2018 Takada ..... G03G 21/206
2018/0217553 A1 * 8/2018 Yasui ..... G03G 15/657
2019/0384216 A1 * 12/2019 Yoshioka ..... G03G 21/206
2020/0073293 A1 * 3/2020 Ichiki ..... G03G 21/1604
2020/0096912 A1 * 3/2020 Goda ..... G03G 21/1604
2020/0096915 A1 * 3/2020 Hashimoto ..... G03G 15/0189
2020/0310304 A1 * 10/2020 Hagiwara ..... G03G 15/0142
2020/0310305 A1 * 10/2020 Tanaka ..... G03G 21/14

* cited by examiner

IMAGE FORMING APPARATUS

CROSS-REFERENCE TO RELATED APPLICATIONS

This application is based on and claims priority under 35 USC 119 from Japanese Patent Application No. 2020-050140 filed Mar. 19, 2020.

BACKGROUND

(i) Technical Field

The present disclosure relates to an image forming apparatus.

(ii) Related Art

An image forming apparatus disclosed in Japanese Unexamined Patent Application Publication No. 2007-304192 includes: a plurality of process cartridges that can be attached to and removed from the body of the apparatus and that are arranged in tandem; a transport belt that is opposed to the process cartridges and that transports a recording medium in the vertical direction; a cover body provided on the body of the apparatus so as to be capable of being opened and closed, the cover body enabling the transport belt to retract and exposing the process cartridges when opened; identifier members provided on the process cartridges and having different shapes or being provided at different positions according to the colors of the process cartridges; identifying members provided on the body of the apparatus to indicate whether the process cartridges are located at proper set positions based on whether or not they interfere with the identifier members; and a transport-belt retracting device that retracts the transport belt toward the cover body when the cover body is closed with any of the process cartridges being located at an improper set position.

SUMMARY

Aspects of non-limiting embodiments of the present disclosure relate to providing an image forming apparatus in which, compared with an image forming apparatus in which image forming parts are disposed adjacent to multiple image transport paths opposed to a medium transport path, an airflow is more easily formed between the image forming parts and the image transport paths.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a medium transport path; a first image transport path that is disposed so as to oppose the medium transport path and along which an image to be formed on the medium is transported; an image forming part that forms the image and is disposed adjacent to the first image transport path; and a second image transport path that is disposed so as to oppose the medium transport path, that is located at a distance from the image forming part, that is disposed so as to surround the image forming part, together with the first image transport path and the medium transport path, and along which an image to be formed on the medium is transported.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
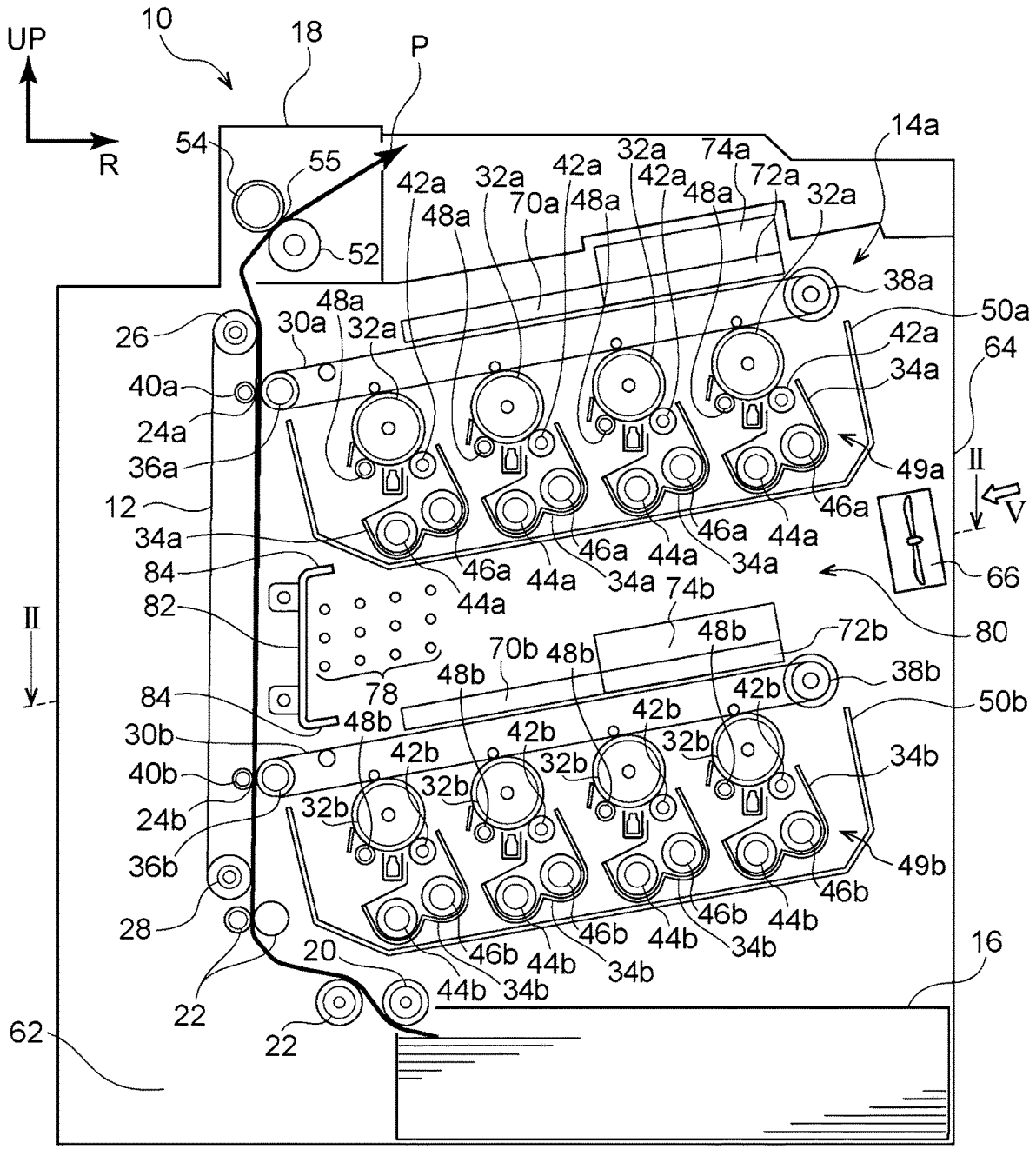
FIG. 1 is a front view showing the internal structure of an image forming apparatus according to a first exemplary embodiment.

An example of an image forming apparatus according to a first exemplary embodiment of the present disclosure will be described below with reference to FIGS. 1 to 5. In the drawings, arrow UP indicates the upper side in the vertical direction; arrow R indicates the right side in the horizontal direction when facing the apparatus; arrow L indicates the left side in the horizontal direction when facing the apparatus; and arrow D indicates the depth direction in the horizontal direction when facing the apparatus. In the description below, when the top or bottom direction is specified without any presumption, it means the top or bottom direction of the apparatus shown in FIG. 1; when the left or right direction is specified without any presumption, it means the left (L) or right (R) direction of the apparatus shown in FIG. 1 when viewed from the front side; and when the depth (near/far) direction is specified without any presumption, it means the depth direction of the apparatus shown in FIG. 2 when viewed from the front side.

Overall Structure of Image Forming Apparatus 10

First, the outline of the structure of an image forming apparatus 10 (hereinbelow, simply "apparatus 10") will be described in sequence along a sheet transport path.

FIG. 1 shows the apparatus 10 in which a near-side cover 60 (see FIG. 2) is removed to show the internal structure. As shown in FIG. 1, the image forming apparatus 10 includes: a transport belt 12, which comes into contact with the back surface of a sheet, serving as an example of a medium on which an image is to be formed, and transports the sheet along a sheet transport path P; an image forming unit 14*a* and an image forming unit 14*b* that form images using an electrophotographic system; a sheet tray 16 that stores sheets; and a fixing unit 18 that fixes the images to the sheet. The image forming unit 14*a* and the image forming unit 14*b* are provided at a distance from each other.

The sheets stored in the sheet tray 16 are fed to the transport belt 12 by a supply roller 20, serving as an example of a sheet (medium) supply unit. The sheet is transported between the supply roller 20 and the transport belt 12 by transport rollers 22 provided along the transport path P.

Toner images formed by the image forming unit 14*a* and the image forming unit 14*b*, opposed to the transport belt 12, are transferred to a sheet supplied to the transport belt 12 at a transfer part 24*a* and a transfer part 24*b*. The image forming unit 14*a* and the transfer part 24*a* are located on the downstream side, and the image forming unit 14*b* and the transfer part 24*b* are located on the upstream side in the sheet transport direction.

The sheet to which the toner images have been transferred is transported from the transport belt 12 to the fixing unit 18, where the toner images are fixed. The sheet is then discharged outside the apparatus 10 or is supplied to the transport belt 12 again through a transport path (not shown).

Next, the outline of the structure of the image forming apparatus 10 will be described in accordance with the positions of the respective components.

As shown in FIG. 1, the sheet tray 16 is provided at the bottom of the image forming apparatus 10. The transport belt 12 extending along the sheet transport path P is provided to the upper left of the sheet tray 16. The transport surface of the transport belt 12 extends in the vertical direction. Multiple transport rollers 22 are provided along the sheet transport path P, between the supply roller 20 and the transport belt 12, at different levels in the vertical direction. With this structure, a sheet supplied from the sheet tray 16 by the supply roller 20 is transported to the left and then upward by the multiple transport rollers 22 and is transported further upward by the transport belt 12.

The image forming unit 14*a* and the image forming unit 14*b* are opposed to the transport surface of the transport belt 12. The image forming unit 14*a* and the image forming unit 14*b* are disposed on top of each other in the vertical direction with a certain distance therebetween. The image forming unit 14*a* is disposed above the image forming unit 14*b*. Hence, the transfer part 24*a*, which includes the image forming unit 14*a* and the transport belt 12, is located above the transfer part 24*b*, which includes the image forming unit 14*b* and the transport belt 12.

The fixing unit 18 is provided above the transport belt 12. The sheet transported upward by the transport belt 12 is directed sideward by a transport roller (not shown), passes through the fixing unit 18, and is discharged outside the apparatus. Alternatively, the sheet transported upward by the transport belt 12 is transported along a transport path (not shown) and is supplied again to the lower end of the transport surface of the transport belt 12.

Next, the structures of the respective components of the image forming apparatus 10 will be described in detail.

Transport Belt 12

As shown in FIG. 1, the transport belt 12 is stretched between a roller 26 and a roller 28 that are spaced apart in the vertical direction. The roller 26 on the upper side (i.e., on the downstream side in the sheet transport direction) also serves as a driven part and is rotated by receiving a driving force from a driving source (not shown). The rotation of the roller 26 rotates the transport belt 12. A portion of the transport belt 12 overlapping the sheet transport path P is an example of a "path" along which a medium is transported.

Image Forming Units 14*a* and 14*b*

As shown in FIG. 1, because the image forming unit 14*a* on the upper side and the image forming unit 14*b* on the lower side have basically the same structure, the image forming unit 14*a* will be described in the following explanation. Components related to the image forming unit 14*b* are denoted by reference numbers with a suffix "b", and descriptions thereof will be omitted.

The image forming unit 14*a* includes an intermediate transfer belt 30*a* (an example of a first image transport path), four image forming parts 49*a* disposed side-by-side in the circumferential direction of the intermediate transfer belt 30*a*, and a housing 50*a* accommodating the image forming parts 49*a*.

Intermediate Transfer Belt 30*a*

As shown in FIG. 1, the intermediate transfer belt 30*a* is an endless belt stretched between a roller 36*a* and a roller 38*a* that are spaced apart in the left-right direction. The roller 36*a* is located at the left end (i.e., on the downstream side in the toner-image transport direction) of the intermediate transfer belt 30*a*, and the roller 38*a* is located at the right end (i.e., on the upstream side in the toner-image transport direction) of the intermediate transfer belt 30*a*. Thus, the intermediate transfer belt 30*a* has a horizontally elongated shape.

The roller 38*a* at the right end is located slightly above the roller 36*a* at the left end. Hence, the intermediate transfer belt 30*a* is slightly inclined such that the right end is higher. The roller 36*a* at the left end has a gear (not shown), which is a driven part receiving a driving force from a driving source. The roller 38*a* at the right end applies tension to the intermediate transfer belt 30*a* to maintain the orientation of the intermediate transfer belt 30*a*.

The roller 36*a* at the left end is opposed to the transport belt 12. Similarly, a roller 36*b* supporting an intermediate transfer belt 30*b* at the left end is also opposed to the transport belt 12. Thus, there is an area surrounded by the transport belt 12, the intermediate transfer belt 30*a*, and the intermediate transfer belt 30*b*. The image forming parts 49*a* are located in this area. Herein, the term "surrounded" means to be surrounded on at least three sides.

Image Forming Part

The image forming parts 49*a* each include a photoconductor 32*a*, a developing device 34*a*, a developing roller 42*a*, a stirring roller 44*a*, a stirring roller 46*a*, and a charging roller 48*a*. As described above, the image forming parts 49*a* are surrounded on at least three sides by the transport belt 12, the intermediate transfer belt 30*a*, and the intermediate transfer belt 30*b*. A driving source (not shown) for supplying a driving force is connected to each image forming part 49*a*.

Transfer Part 24*a*

The left end of the intermediate transfer belt 30*a* is in contact with the transport belt 12. This contact portion serves as the transfer part 24*a*. A second transfer roller 40*a* for applying a second transfer bias is disposed so as to oppose the roller 36*a* with the transport belt 12 therebetween.

Photoconductor 32*a*

Four roller-shaped photoconductors 32*a* are disposed below the intermediate transfer belt 30*a* so as to be in contact with the intermediate transfer belt 30*a*. The photoconductors 32*a* are disposed side-by-side in the left-right direction and are rotated in accordance with the rotation of the intermediate transfer belt 30*a*. The photoconductors 32*a* are also disposed in an inclined manner such that the right side is higher, in accordance with the inclination of the intermediate transfer belt 30*a*.

Developing Device 34*a*

Developing devices 34*a* are disposed below the photoconductors 32*a*. The developing devices 34*a* each include a developing roller 42*a* that develops a toner image on the photoconductor 32*a*, and two stirring rollers, namely, a stirring roller 44*a* and a stirring roller 46*a*, for transporting developer containing toner while stirring.

Charging Roller 48*a*

A charging roller 48*a* for charging the surface of the photoconductor 32*a* is disposed below the photoconductor 32*a*, to the left of the developing device 34*a*. The charging roller 48*a* to which a voltage is applied is rotated in accordance with the rotation of the photoconductor 32*a*, while being in contact with the surface of the photoconductor 32*a*.

Boards

As shown in FIG. 1, a control board 70*a* and a control board 72*a*, serving as an example of a controller for controlling the operation of the image forming unit 14*a*, and a power supply board 74*a*, serving as an example of a power supply circuit for supplying voltage to the image forming unit 14*a*, are disposed above the intermediate transfer belt 30*a*. The control board 70*a* is located on the left side of the image forming unit 14*a*, and the control board 72*a* and the power supply board 74*a* are located on the right side of the image forming unit 14*a*.

The control board 72*a* is located on the near side, and the power supply board 74*a* is located on the far side of the apparatus 10.

The control board 70*a*, the control board 72*a*, and the power supply board 74*a* are disposed in an inclined manner along the inclination of the intermediate transfer belt 30*a* such that the right side is higher.

The power supply board 74*a* is an example of a low-voltage power supply (LV/LVPS) board.

Housing 50*a*

The intermediate transfer belt 30*a*, the four photoconductors 32*a*, the four developing devices 34*a*, the charging rollers 48*a*, and the driving sources are held together by the housing 50*a*. The housing 50*a*, while holding them together, can be attached to and detached from the body of the apparatus 10 to which the transport belt 12 is attached.

The lower side (bottom) of the housing 50*a* is inclined such that the right side is higher, so as to conform to the positions of the four photoconductors 32*a* and the four developing devices 34*a*.

Driving Source

A driving source (not shown) having a driving gear (not shown) is provided on the near-side surface of the housing 50*a*. The gear is in mesh with driven parts (driven gears (not shown)) provided on the roller 36*a*, the photoconductors 32*a*, the charging roller 48*a*, the developing roller 42*a*, the stirring roller 44*a*, and the stirring roller 46*a* via multiple intermediate gears (not shown). In this way, the rotary members on the housing 50*a* can receive rotational driving force from a single driving source. The rotation speeds of the rotary members are adjusted by the peripheral speed ratios of the multiple intermediate gears.

Fixing Unit 18

As shown in FIG. 1, the fixing unit 18 includes a fixing roller 52, which also serves as a driven part, and a roller-shaped fixing belt 54. More specifically, the driven part includes a gear (not shown) provided integrally and coaxially with the fixing roller 52. The fixing roller 52 is disposed so as to be in contact with the surface of a transported sheet to which toner images are transferred.

The fixing belt 54 is disposed so as to oppose the fixing roller 52 with the sheet transport path P therebetween. The fixing roller 52 and the fixing belt 54 interfere with each other, forming a fixing nip 55. The fixing belt 54 is rotated in a driven manner by the rotation of the fixing roller 52.

In this exemplary embodiment, the rotation speed of the fixing roller 52 in the fixing unit 18 is set to be slightly lower than the sheet transport speed with the transport belt 12. Because of this difference in speed, the sheet transported between the transport belt 12 and the nip 55 becomes slack. Owing to this slack, even when the sheet is simultaneously nipped at the transfer part 24*a* and the nip 55, the sheet can be transported without being pulled toward the transfer part 24*a* or the nip 55.

Structure of Relevant Part

Next, the structure of the relevant part in this exemplary embodiment will be described.

Ventilation Passage 80

As shown in FIG. 1, in the apparatus 10, an area between the image forming unit 14*a* and the image forming unit 14*b* serves as a ventilation passage 80 (an example of an outside-air passage). More specifically, the passage 80 is an area (space) surrounded by: a metal plate 82 covering the left side; the image forming unit 14*a* covering the upper side; the image forming unit 14*b* covering the lower side; a cover 64 and a drawing device 66 (described below) covering the right side; a cover 62 covering the far side; and a cover 60 covering the near side. The far side and the near side of the passage 80 may be covered by separately provided walls provided on the inner side of the cover 60 and the cover 62. For example, frames or inner walls formed of metal plates (not shown) may be provided on the inner side of the cover 60 and the cover 62.

More specifically, the upper side of the passage 80 is covered by the bottom surface of the housing 50*a* of the image forming unit 14*a*, and the lower side of the passage 80 is covered by the intermediate transfer belt 30*b* (an example of a second image transport path) of the image forming unit 14*b*, a control board 70*b*, a power supply board 72*b*, and a power supply board 74*b*.

Vent Holes 76 and 78

Figure 2:
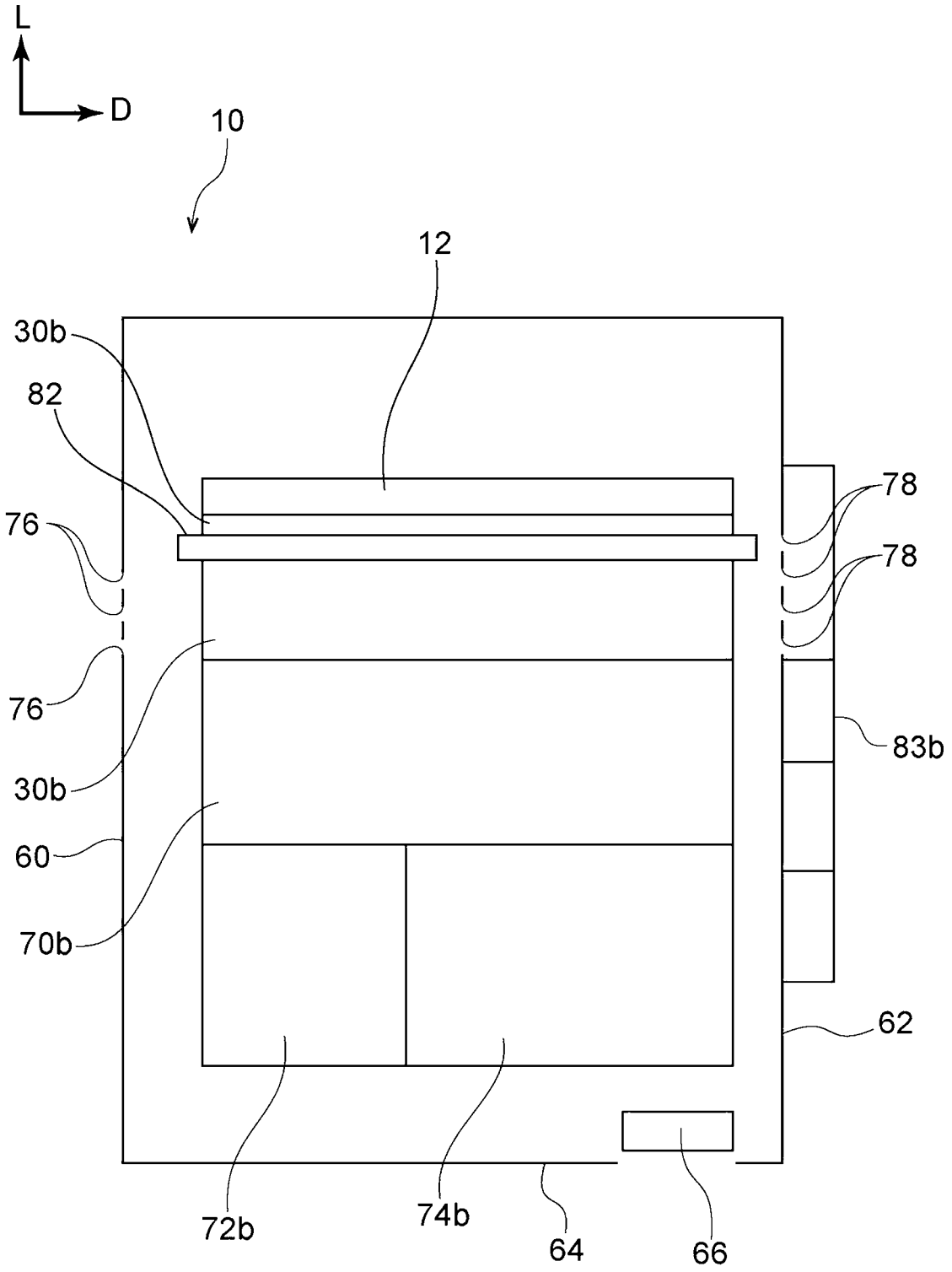
FIG. 2 is a sectional view taken along line II-II in FIG. 1.

As shown in FIG. 2, the cover 60 on the near side of the passage 80 has multiple vent holes 76, and the cover 62 on the far side has multiple vent holes 78.

Figure 3:
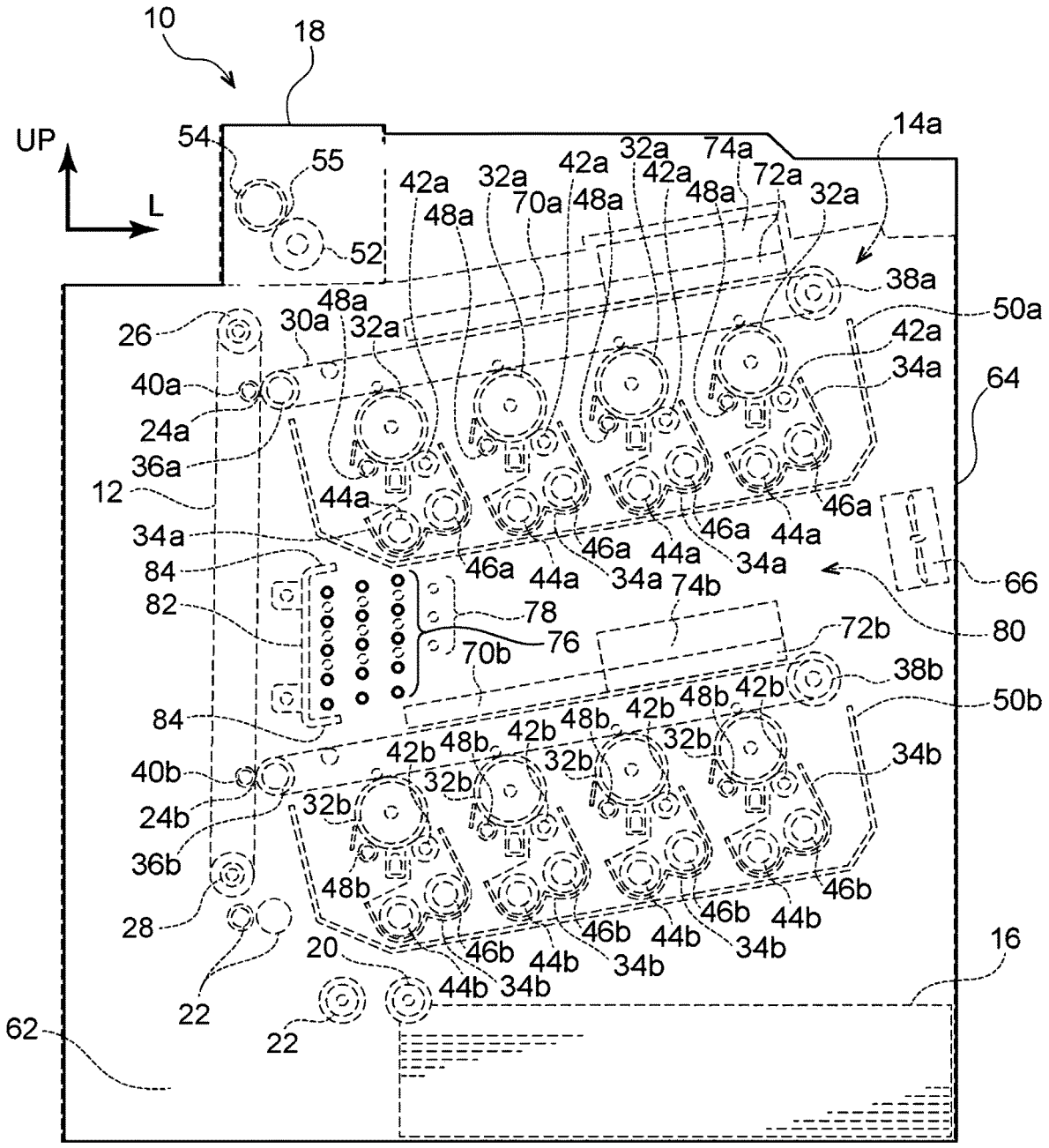
FIG. 3 is a front view of the image forming apparatus in FIG. 1.

As shown in FIG. 3, the vent holes 76 are provided in the cover 60 constituting the side surface on the near side of the ventilation passage 80.

At least some of the vent holes 76 are located to the left (i.e., closer to the transport belt 12) of the developing device 34*a* on the extreme left side in the image forming unit 14*a* on the upper side.

Furthermore, at least some of the vent holes 76 are located to the left of the control board 70*b*, the power supply board 72*b*, and the power supply board 74*b* in the image forming unit 14*b* on the lower side.

As shown in FIG. 2, the vent holes 78 are provided in the cover 62 constituting the side surface on the far side of the ventilation passage 80.

Figure 4:
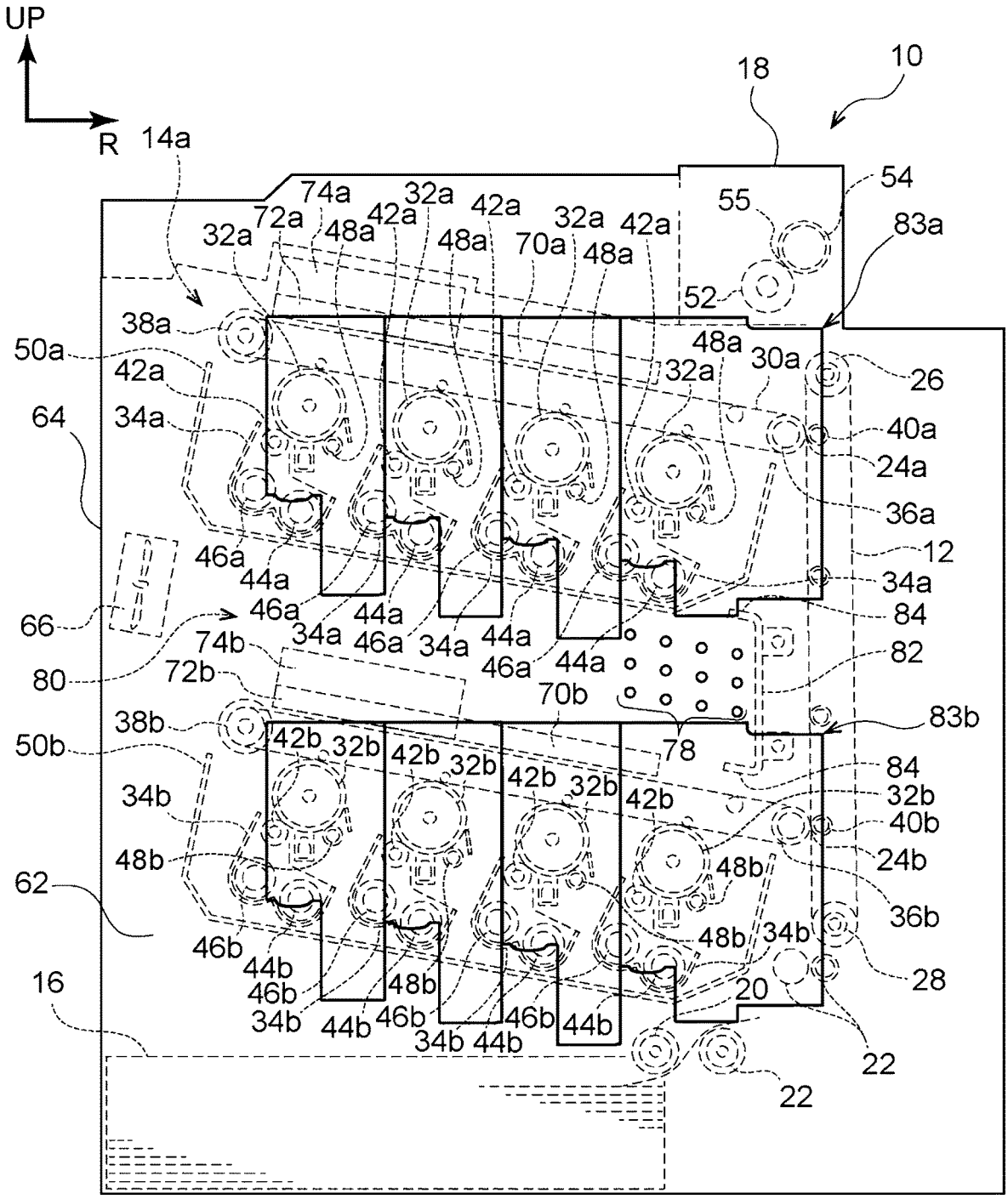
FIG. 4 is a back view of the image forming apparatus in FIG. 1.

As shown in FIG. 4, upper toner cartridges 83*a* provided at a position corresponding to the upper image forming unit 14*a* and lower toner cartridges 83*b* provided at a position corresponding to the lower image forming unit 14*b* are provided on the back surface side of the cover 62. Hence, the vent holes 78 in the cover 62 are located at a position between the toner cartridges 83*a* and the toner cartridges 83*b* so as to avoid the toner cartridges 83*a* and 83*b*.

FIG. 3 shows the positional relationship between the vent holes 76 on the near side and the vent holes 78 on the far side. Whereas the vent holes 76 are distributed in a vertically long area on the near side of the apparatus 10, the vent holes 78 are distributed in a horizontally long area on the far side of the apparatus 10 to avoid the upper and lower toner cartridges 83*a* and 83*b*. More vent holes 76 are provided on the left side (i.e., the side closer to the transport belt 12) than the vent holes 78, which are provided so as to avoid the toner cartridges 83*a* and 83*b*.

Drawing Device 66

As shown in FIG. 1, the drawing device 66, which is an example of a generating device that generates an airflow and is an example of a discharging device that discharges air, is provided on the right side of the ventilation passage 80. More specifically, the drawing device 66 is located on the opposite side of the upper intermediate transfer belt 30*a* and the lower intermediate transfer belt 30*b* from the transport belt 12 constituting the sheet transport path P.

As shown in FIG. 2, the drawing device 66 is provided on the far side of the apparatus 10.

The drawing device 66 draws the air in the passage 80 from the side near the transport surface of the transport belt 12 (left side) toward the outside of the apparatus 10 (right side), that is, in a direction away from the transport surface, and discharges the air. In this exemplary embodiment, the drawing device 66 is a centrifugal fan.

With this structure, the air in the passage 80 is discharged outside the apparatus 10 by the drawing device 66. As a result, the air outside the apparatus 10 is introduced into the passage 80 through the vent holes 76 and 78.

More specifically, the outside air introduced from the vent holes 76, which are provided on the near left side of the apparatus 10, flows diagonally through the passage 80 and is discharged outside the apparatus 10 by the drawing device 66, which is provided on the far right side of the apparatus 10. The outside air introduced from the vent holes 78, which are provided on the far left side of the apparatus 10, flows from the left to the right on the far side of the passage 80 and is discharged outside the apparatus 10 by the drawing device 66, which is provided on the far right side of the apparatus 10.

Metal Plate 82

As shown in FIG. 1, the metal plate 82 (an example of a wall), which covers the transport belt 12 as viewed from the transport surface of the transport belt 12, is disposed on the left side of the ventilation passage 80. The metal plate 82 has a flat surface facing the transport surface of the transport belt 12. The metal plate 82 is attached to a frame (not shown) provided in the apparatus 10.

The metal plate 82 is located closer to the transport belt 12 (i.e., the left side) than the vent holes 76 provided in the cover 60 on the near side and the vent holes 78 provided in the cover 62 on the far side of the apparatus 10 are.

The length of the metal plate 82 in the vertical direction is larger than the lengths of the areas in which the vent holes 76 and the vent holes 78 are provided. Hence, the upper end of the metal plate 82 is located above the upper end of the vent hole 76 or the vent hole 78 that is located on the extreme upper side, and the lower end of the metal plate 82 is located below the lower end of the vent hole 76 or the vent hole 78 that is located on the extreme lower side.

The metal plate 82 has bent portions 84 extending in the horizontal direction (left-right direction in the apparatus 10) at the upper and lower ends thereof. The bent portions 84 are formed by bending the upper and lower ends of the metal plate 82.

The bent portions 84 formed at the upper and lower ends of the metal plate 82 extend in a direction away from the transport surface of the transport belt 12. The ends (right ends in FIG. 1) of the bent portions 84 are located to the right of the vent holes 76 or the vent holes 78 that are located on the extreme left side. In other words, the metal plate 82 is formed in a substantially U shape so as to cover the left side, the upper left side, and the lower left side of the areas in the cover 60 on the near side and the cover 62 on the far side in which the vent holes 76 and the vent holes 78 are provided, in a front view of the apparatus 10.

Figure 5:
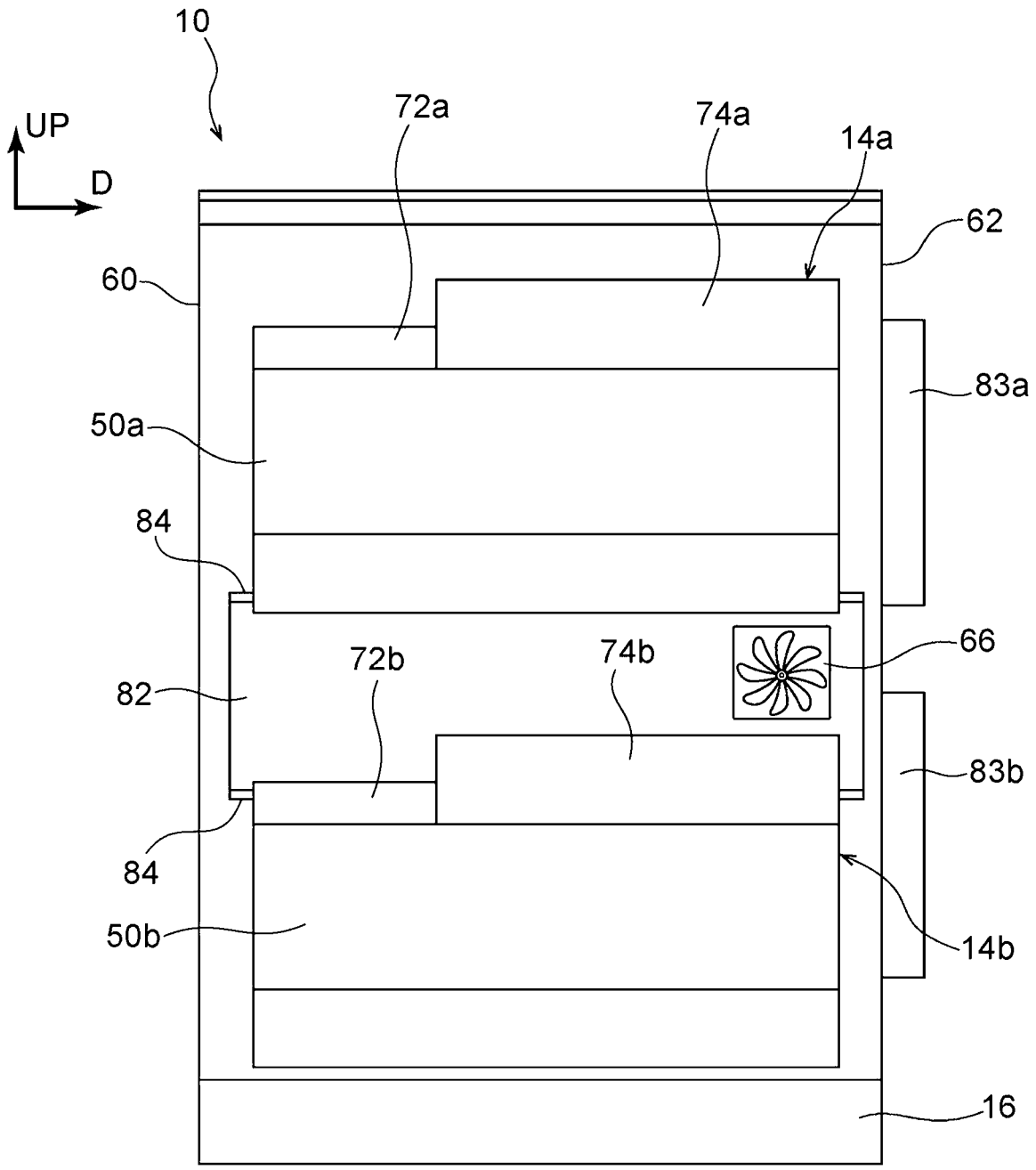
FIG. 5 is a side view of the image forming apparatus in FIG. 1, as viewed from arrow V.

As shown in FIG. 5, when the passage 80 is viewed from direction V in FIG. 1 (i.e., from the right side of the apparatus 10 and a direction parallel to the inclination of the housing 50*a* and the housing 50*b*, as viewed from the drawing device 66), the transport belt 12 is behind the metal plate 82 and cannot be viewed.

Effects

Next, the effects of this exemplary embodiment will be described.

As shown in FIG. 1, in this exemplary embodiment, the ventilation passage 80 is formed between the image forming unit 14*a* on the upper side and the image forming unit 14*b* on the lower side. With this structure, it is easy to generate an airflow between the image forming units 14*a* and 14*b*, compared with a structure in which the image forming units are close to each other. Hence, air heated by the heat released from the image forming unit 14*a* or the image forming unit 14*b* can be easily replaced with fresh air.

The passage 80 is inclined upward in a direction away from the transport belt 12. Hence, the air heated by the heat released from the image forming unit 14*a* or the image forming unit 14*b* flows upward along the passage 80. With this structure, the heated air easily flows in the direction away from the transport belt 12, compared with a structure in which the passage 80 is inclined downward in the direction away from the transport belt 12. Hence, in this exemplary embodiment, the air in the passage 80 can be efficiently cooled.

In this exemplary embodiment, the intermediate transfer belt 30*a* and the intermediate transfer belt 30*b* are in contact with the transport belt 12 at the transfer parts 24*a* and 24*b*. Hence, the left side of the passage 80 is surrounded by these components, and thus, the air in the passage 80 is likely to be trapped in this area. To counter this problem, a structure in which the air in the passage 80 flows toward the right side of the apparatus 10 (i.e., in the direction away from the transport belt 12), as shown in FIG. 1, is desired.

Furthermore, in this exemplary embodiment, the air in the passage 80 is caused to flow (i.e., an airflow is generated) by a generating device (drawing device 66) for generating an airflow. Hence, an airflow is reliably generated in the passage 80, compared with a structure without the drawing device 66.

The drawing device 66 draws (discharges) the air in the passage 80 in the direction away from the transport surface of the transport belt 12. With this structure, even though the left side of the passage 80 is closed by the transport belt 12, an airflow that brings the air in the passage 80 in the direction away from the transport belt 12 is generated, compared with a structure in which the air in the passage 80 is drawn in the depth direction.

Furthermore, the control board 70*b* is provided above the lower image forming unit 14*b* with a certain distance from the upper image forming unit 14*a*. With this structure, an airflow is more efficiently generated around the control board 70*b*, compared with a structure in which the control board 70*b* and the upper image forming unit 14*a* are close to each other. Thus, the air heated by the control board 70*b* can be efficiently replaced with fresh air.

The power supply board 74*b* is provided above the lower image forming unit 14*b*, to the right side of the control board 70*b*, with a certain distance from the upper image forming unit 14*a*. With this structure, an airflow is efficiently generated around the power supply board 74*b*, compared with a structure in which the power supply board 74*b* and the upper image forming unit 14*a* are close to each other.

Furthermore, air having a higher temperature can be efficiently replaced with fresh air by the drawing device 66, compared with a structure in which the power supply board 74*b*, which generates more heat than the control board 70*b*, is disposed on the left side.

The power supply board 74*b* is disposed on the far side (i.e., near the drawing device 66) of the apparatus 10. With this structure, air having a higher temperature can be efficiently replaced with fresh air, compared with a structure in which the power supply board 74*b* is disposed on the near side.

Furthermore, the vent holes 76 and the vent holes 78, through which the outside air passes, are provided to the sides of the sheet transport path P in the passage 80. With this structure, the outside air is efficiently introduced into the passage 80, compared with a structure without the vent holes 76 or the vent holes 78.

Because both the vent holes 76 on the near side of the passage 80 and the vent holes 78 on the far side of the passage 80 are provided, the outside air is efficiently introduced into the passage 80, compared with a structure in which only the vent holes 76 or only the vent holes 78 are provided.

The vent holes 76 on the near side of the passage 80 and the vent holes 78 on the far side of the passage 80 are closer to the transport belt 12 than the extreme-left developing device 34*a* in the upper image forming unit 14*a* is. With this structure, an airflow is more efficiently generated around the developing device 34*a*, compared with a structure in which the vent holes 76 and the vent holes 78 are farther from the transport belt 12 (i.e., to the right side of the developing device 34*a*) than the developing device 34*a* is.

The toner cartridges 83*a* and 83*b* for supplying toner to the image forming units 14*a* and 14*b* are provided on the far-side wall of the apparatus 10. Hence, the cover 62 on the far side of the apparatus 10 has a limited area for the vent holes 78. Thus, the number of the vent holes 78 is smaller than the number of the vent holes 76 on the near side. Accordingly, more outside air is introduced from the vent holes 76 on the near side than the vent holes 78 on the far side.

Because the drawing device 66 is provided on the far side, the outside air (air) introduced from the vent holes 76 on the near side flows diagonally from the near left side toward the far right side in the passage 80. Hence, compared with a case where the drawing device 66 is provided on the near side, more outside air (air) flows through a long path in the passage 80. In other words, the passage 80 is efficiently ventilated.

The metal plate 82 is disposed so as to cover the transport surface of the transport belt 12. With the structure according to this exemplary embodiment, a sheet is transported in the vertical direction on the transport belt 12, along the transport path P. At this time, the sheet sticks to the transport belt 12 by electrostatic force. In this transport state, compared with a structure in which a sheet is transported in the horizontal direction, the sheet is likely to come off the transport path P during transportation.

Furthermore, in this structure, the air in the passage 80 is drawn in the direction away from the transport belt 12 by the drawing device 66. Hence, the sheet is more likely to come off the transport path P due to the airflow during transportation.

To counter this problem, in this structure, the metal plate 82 covers the transport path P. With this structure, compared with a structure in which a wall is provided so as to avoid a medium being transported, influence of airflow on the medium is suppressed.

The metal plate 82 is disposed to the left side of the vent holes 76 and 78. With this structure, the outside air (air) introduced from the vent holes 76 and 78 is more easily guided to the right side, compared with a structure in which the metal plate is disposed to the right side of the vent holes 76 and 78.

The metal plate 82 has the bent portions 84 extending to the right. With this structure, the outside air (air) introduced from the vent holes 76 and 78 is more easily guided to the right side, compared with a structure in which the bent portions 84 extend to the left.

The length of the metal plate 82 in the vertical direction is larger than the distance between the upper end and the lower end of the vent holes 76 and 78. With this structure, the outside air (air) introduced from the vent holes 76 and 78 is more easily guided to the right side, compared with a structure in which the length of the metal plate 82 in the vertical direction is smaller than the distance between the upper end and the lower end of the vent holes 76 and 78.

Second Exemplary Embodiment

An image forming apparatus 110 according to a second exemplary embodiment of the present disclosure will be described with reference to FIG. 6. Because the image forming apparatus 110 according to this exemplary embodiment is a modification of the image forming apparatus 10 according to the first exemplary embodiment, the components the same as those in the first exemplary embodiment will be denoted by identical or like reference signs, and descriptions thereof will be omitted where appropriate.

Figure 6:
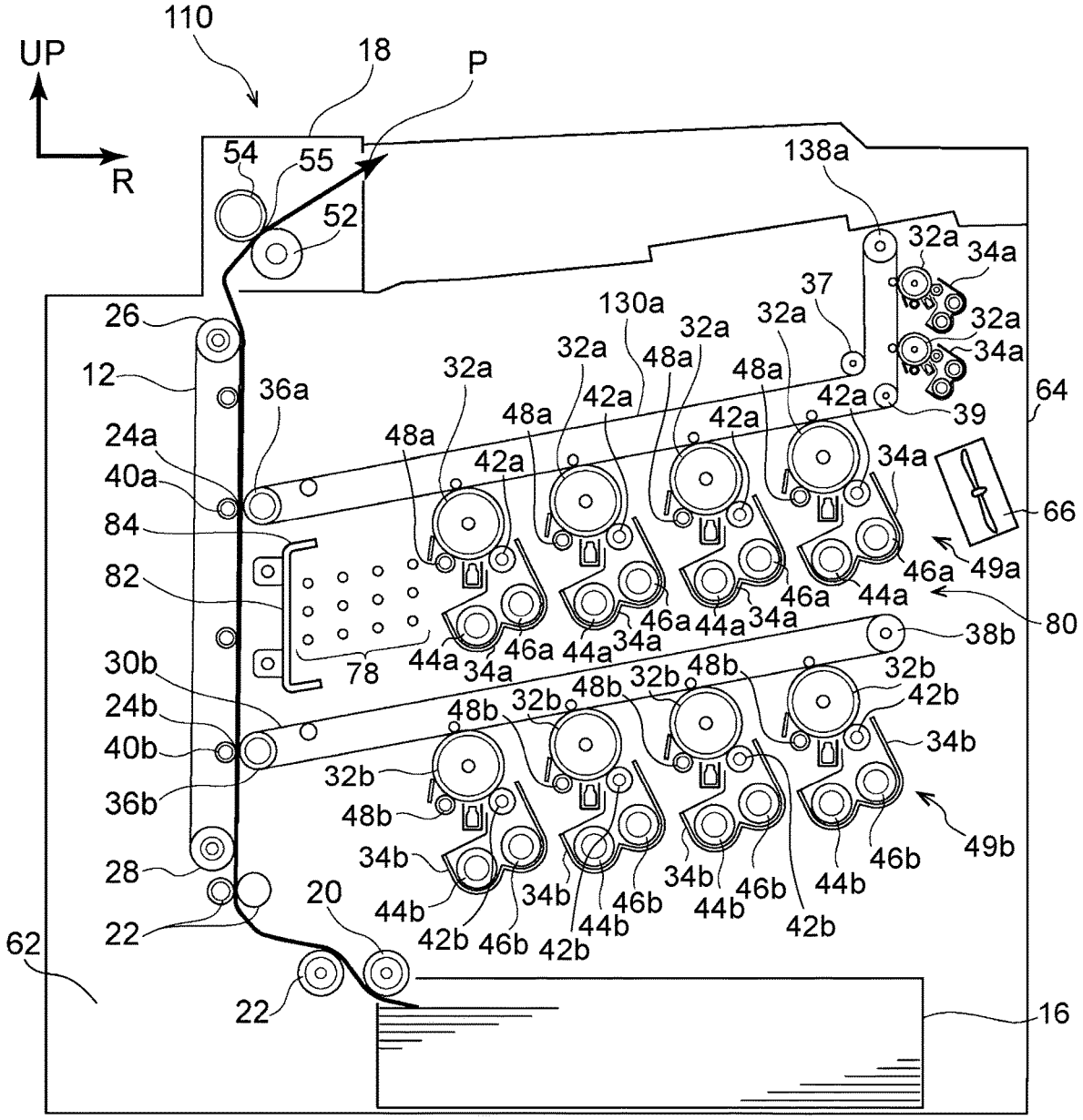
FIG. 6 is a front view showing the internal structure of an image forming apparatus according to a second exemplary embodiment.

As shown in FIG. 6, the right end of an intermediate transfer belt 130*a* in this exemplary embodiment is bent upward by a support belt 37 and a support belt 39 and is stretched over a roller 138*a* located above the support belt 37 and the support belt 39. With this structure, the intermediate transfer belt 130*a* is supported in a substantially L shape with the short line extending upward.

By supporting the intermediate transfer belt 130*a* in this shape, the intermediate transfer belt 130*a* having a large perimeter can be disposed in a small area, compared with a structure in which the belt is supported only at the ends thereof. This structure also enables more image forming parts 49*a* to be disposed adjacent to the intermediate transfer belt 138*a*.

In this exemplary embodiment, it is assumed that the image forming apparatus 110 discharges heat generated by the image forming parts 49*a*. Inside the developing devices 34*a* constituting the image forming parts 49*a*, developer containing toner and carrier is stirred. As a result, the developing devices 34*a* are heated by the friction between the toner and the carrier. The developer may also be heated by applying voltage. Due to these factors, the developer reaches a high temperature and is more rapidly deteriorated. Deteriorated developer may cause defective charging or poor image quality.

In the image forming apparatus 110 according to this exemplary embodiment, the image forming parts 49*a* are disposed adjacent to the intermediate transfer belt 130*a* and away from the intermediate transfer belt 30*b*. In other words, the passage 80 (an example of an outside-air passage), through which the outside air passes, is formed between the image forming parts 49*a* and the intermediate transfer belt 30*b*.

Effects

Next, the effects of this exemplary embodiment will be described.

In this exemplary embodiment, the image forming parts 49*a* are heated by the heat generated by the developing devices 34*a*. In particular, when there are multiple image forming parts 49*a* in the apparatus 110, the air near the image forming parts 49*a* is trapped, and a temperature rise due to the heat generated by the image forming parts 49*a* becomes more obvious. The air around the image forming parts 49*a* is drawn by the drawing device 66 and is discharged outside the image forming apparatus 110. Furthermore, the outside air introduced through the vent holes 78 flows into the area surrounded by the transport belt 12, the intermediate transfer belt 130*a*, and the intermediate transfer belt 30*b*. As a result, the air around the image forming parts 49*a* is replaced with fresh air, cooling the image forming parts 49*a*. The vent holes 78 may be provided so as to overlap any of the image forming parts 49*a* in front view in FIG. 6. With such a structure, the outside air can be directly guided to the image forming part 49*a*. Hence, even when there are multiple image forming parts 49*a* in the apparatus 110, it is possible to cool the image forming part 49*a* without being influenced by the positions of the other image forming parts 49*a*.

In the image forming apparatus 110, multiple image forming parts 49*a* are provided adjacent to the intermediate transfer belt 130*a*. The vent holes 78 are provided at a position closer to the transport belt 12 than at least the image forming parts 49*a* provided on the transport belt 12 side with respect to the center, among the multiple image forming parts 49*a*. With this structure, the outside air introduced from the vent holes 78 flows through a larger number of image forming parts 49*a*.

More specifically, the vent holes 78 are provided at a position closer to the transport belt 12 than the image forming part 49*a* provided on the extreme transport belt 12 side, among the multiple image forming parts 49*a*, is. With this structure, the outside air introduced from the vent holes 78 flows through an even larger number of image forming parts 49*a*.

In this exemplary embodiment, although there are multiple vent holes 78, at least one of them may be provided at a position overlapping an image forming part 49*a* in front view in FIG. 6 (i.e., as viewed in a direction intersecting the sheet transport direction in the image forming apparatus 110). In that case, the outside air passing through the vent hole 78 is directly supplied to the image forming part 49*a*. Hence, compared with a structure in which the outside air passing through the vent hole 78 is supplied to another component, is reflected, and is then supplied to the image forming part 49*a*, the image forming part 49*a* is efficiency cooled.

Alternatively, the vent holes 78 may be provided at a position overlapping at least an image forming part 49*a* that is closer to the transport belt 12 than the other image forming parts 49*a*, among the multiple image forming parts 49*a*. With this structure, the outside air introduced from the vent holes 78 is supplied to one image forming part 49*a* and is then supplied to the other image forming parts 49*a*. In other words, the outside air passes through a larger number of image forming parts 49*a*.

More specifically, the vent holes 78 may be provided so as to overlap the image forming part 49*a* closest to the extreme transport belt 12, among the multiple image forming parts 49*a*, in front view in FIG. 6 (i.e., as viewed in the direction intersecting the sheet transport direction in the image forming apparatus 110). With this structure, the outside air introduced from the vent holes 78 passes through an even larger number of image forming parts 49*a*.

Other Aspects

Although the image forming apparatuses according to the exemplary embodiments of the present disclosure have been described above, various aspects are of course possible without departing from the scope of the present disclosure. For example, it has been described that the image forming units 14*a* and 14*b* respectively include four photoconductors 32*a* and 32*b*, four developing devices 34*a* and 34*b*, and four charging rollers 48*a* and 48*b*. However, the number of these components may be larger or smaller than four, as long as it is more than one. Although the transport belt 12 has been described as an example of a medium transport path in the above-described exemplary embodiments, the medium transport path is not limited thereto. For example, in a structure in which continuous paper or label paper is transported along a transport path P supported by rollers on the upstream side and on the downstream side, the transport belt 12 may be omitted. Also when the image forming medium is cut paper, the transport path P may be formed of multiple rollers, and the transport belt 12 may be omitted. In these structures, the area surrounded by the multiple intermediate transfer belts and an image forming medium can be ventilated by using the above-described structures according to the exemplary embodiments.

Although it has been described that the photoconductors 32*a* and 32*b* are located below the intermediate transfer belts 30*a* and 30*b* in the image forming units 14*a* and 14*b*, the positional relationship therebetween may be reversed. Furthermore, although it has been described that the intermediate transfer belts 30*a* and 30*b* are stretched over the rollers 36*a* and 38*a* and the rollers 36*b* and 38*b* disposed at a distance from each other in the left-right direction, the belts may be stretched over more than two rollers. In that case, the intermediate transfer belt stretched over more than two rollers is held in, for example, a substantially triangular or rectangular shape.

In this exemplary embodiment, the upstream side of the sheet transport path P is located on the lower side of the apparatus 10, and the downstream side of the sheet transport path P is located on the upper side of the apparatus 10. With this structure, the sheet is transported from the lower side to the upper side of the apparatus 10. However, the sheet transport path P may be disposed such that, for example, the upstream side and the downstream side thereof are located side-by-side. In that case, for example, the upstream side of the transport path P may be on the left side of the apparatus 10, and the downstream side of the transport path P may be on the right side of the apparatus 10. With this structure, the image forming unit 14*a* on the upstream side and the image forming unit 14*b* on the downstream side may be disposed side-by-side along the sheet transport path P.

The upstream side and the downstream side of the sheet transport path P may be reversed in the vertical direction. In that case, the sheet tray 16 is located at the upper end of the apparatus 10, the image forming unit 14*b* on the upstream side is located above the lower image forming unit 14*a*, and the fixing unit 18 is located at the lower end of the apparatus 10.

Furthermore, another image forming unit may be disposed between the image forming unit 14*a* on the downstream side and the image forming unit 14*b* on the upstream side. At this time, the passage 80, the drawing device 66, the vent holes 76 and 78, and the metal plate 82 may be provided in each space between the image forming units.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a medium transport path;

a first image transport path that is disposed so as to oppose the medium transport path and along which an image to be formed on the medium is transported;

an image forming part that forms the image and is disposed adjacent to the first image transport path;

a second image transport path that is disposed so as to oppose the medium transport path, that is located at a distance from the image forming part, and along which an image to be formed on the medium is transported, the second image transport path, the first image transport path, and the medium transport path together surrounding the image forming part; and a generating device that generates an airflow between the first image transport path and the second image transport path by drawing the air between the image forming part and the second image transport path in a direction away from the medium transport path.

2. An image forming apparatus comprising:

a medium transport path;

a first image transport path that is disposed so as to oppose the medium transport path and along which an image to be formed on the medium is transported;

an image forming part that forms the image and is disposed adjacent to the first image transport path;

a second image transport path that is disposed so as to oppose the medium transport path and along which an image to be formed on the medium is transported, the second image transport path, the first image transport path, and the medium transport path together surrounding the image forming part;

an outside-air passage provided between the image forming part and the second image transport path and facing the image forming part; and a generating device that generates an airflow in the outside-air passage by drawing air in the outside-air passage in a direction away from the medium transport path.

3. The image forming apparatus according to claim 1, wherein the generating device is a discharging device that discharges air between the image forming part and the second image transport path.

4. The image forming apparatus according to claim 2, wherein the generating device is a discharging device that discharges air between the image forming part and the second image transport path.

5. The image forming apparatus according to claim 3, wherein the discharging device discharges the air between the image forming part and the second image transport path from a lower side to a higher side.

6. The image forming apparatus according to claim 4, wherein the discharging device discharges the air between the image forming part and the second image transport path from a lower side to a higher side.

7. The image forming apparatus according to claim 1, wherein the generating device is disposed on the opposite side of the image forming part from the medium transport path.

8. The image forming apparatus according to claim 1, wherein vent holes communicating with an outside of the apparatus are provided on one side of the image forming apparatus in a direction intersecting a medium transport direction and transport directions in the first image transport path and the second image transport path.

9. The image forming apparatus according to claim 8, wherein the vent holes are provided so as to overlap the image forming part, as viewed in a direction intersecting the medium transport direction.

10. The image forming apparatus according to claim 9, wherein the image forming part is one of a plurality of image forming parts, the plurality of image forming parts are disposed adjacent to the first image transport path, and the vent holes are provided so as to overlap the image forming part located closer to the medium transport path, as viewed in the direction intersecting the medium transport direction.

11. The image forming apparatus according to claim 8, wherein the vent holes are provided at a position closer to the medium transport path than the image forming part is.

12. The image forming apparatus according to claim 11, wherein the image forming part is one of a plurality of image forming parts, the plurality of image forming parts are disposed adjacent to the first image transport path, and the vent holes are provided at a position closer to the medium transport path than the image forming part located closer to the medium transport path is, as viewed in the direction intersecting the medium transport direction.

13. The image forming apparatus according to claim 8, wherein the vent holes are provided on both sides of the image forming apparatus in the direction intersecting the medium transport direction and the transport directions in the first image transport path and the second image transport path.

14. The image forming apparatus according to claim 1, further comprising a wall that covers a portion of the medium transport path between the first image transport path and the second image transport path, as viewed from the generating device.

15. The image forming apparatus according to claim 14, wherein the wall has a bent portion extending toward the generating device at an end thereof in the medium transport direction.

* * * * *